US005221010A

United States Patent [19]

Bianco

[11] Patent Number: 5,221,010

[45] Date of Patent: Jun. 22, 1993

[54] APPARATUS FOR SEGREGATING BOTTLES AND CANS AND THE LIKE

[76] Inventor: James S. Bianco, 217 Brainard Rd., Enfield, Conn. 06082

[21] Appl. No.: 782,115

[22] Filed: Oct. 25, 1991

[51] Int. Cl.[5] ..... B07C 7/04

[52] U.S. Cl. ..... 209/702; 209/703; 209/942; 193/2 R; 193/23; 220/908; 220/909; 232/43.2

[58] Field of Search ..... 209/702, 703, 706, 707, 209/930, 933, 942; 232/43.2, 43.1; 312/121, 124, 321.5, 328; 220/908, 909; 193/2 R, 23, 33

[56] References Cited

U.S. PATENT DOCUMENTS 1,333,233 3/1920 Ward ..... 209/703
3,261,441 7/1966 Mullens ..... 232/43.2 X
4,239,121 12/1980 Hodes ..... 209/703
4,987,988 1/1991 Messina et al. ..... 232/43.2 X
5,083,704 1/1992 Rounthwaite ..... 209/702 X

*Primary Examiner*—Joseph E. Valenza
*Assistant Examiner*—Tuan N. Nguyen
*Attorney, Agent, or Firm*—John H. Crozier

[57] ABSTRACT

In a preferred embodiment, a plurality of conduits extending from a kitchen area to bins in a level beneath the kitchen. In one embodiment, the upper ends of the conduits are concealed behind a vertical panel hinged at the lower edge to an "island" cabinet and forming a surface of the cabinet. The upper ends of the conduits are accessed by rotating the panel outwardly from the cabinet to expose the ends.

3 Claims, 2 Drawing Sheets

FIG. 1

APPARATUS FOR SEGREGATING BOTTLES AND CANS AND THE LIKE

BACKGROUND OF THE INVENTION

1. Field of the Invention.

The present invention relates to the segregation and saving of bottles and cans and the like generally and, more particularly, but not by way of limitation, to a novel apparatus for segregating and saving bottles and cans and the like which, for example, may be easily incorporated into new or existing kitchen cabinetry.

2. Background Art.

Recently, there has been a great deal of attention given to environmental concerns and especially to the landfilling of materials that do not, or do not readily, decompose. The result is that landfills rapidly reach their capacities and, because of the objectionable nature of landfills, new sites are difficult and/or expensive to obtain. In many cases, trash may have to be hauled considerable distances to landfills. A further concern is that many materials deposited in landfills would otherwise have some value as raw materials for recycling processes.

One attempt to decrease the quantity of landfilled materials has been to require a deposit be collected on certain containers, such as soda cans and bottles, when the items are purchased. When the containers are later returned, the deposits are refunded. The deposits are set high enough that most purchasers save the containers for return or, if the containers are nevertheless discarded, scavengers will retrieve them and return them for the deposits.

A further attempt to decrease the quantity of landfilled materials has been the requirement by many municipalities that residences and commercial establishments segregate certain materials so that the trash haulers can keep the materials segregated when picked up. Depending on the municipality, such segregation may include the separation of tin cans and plastic or glass containers.

A problem with both of the above arrangements is that they require a certain degree of discipline to remember to segregate the materials. This can be a particular problem with younger members of a household. Furthermore, in order to maintain such segregation, a kitchen may have to have a first bin for returnable deposit containers, a second bin for nonreturnable containers, a third bin for glass and plastic containers, and a fourth bin for nonsegregatable materials. Thus, conscientious segregation may require a sizable amount of floor space.

Accordingly, it is a principal object of the present invention to provide an apparatus for the convenient segregation of returnable and recyclable materials.

An additional object of the invention is to provide such apparatus which can be easily incorporated into new or existing cabinetry in a kitchen area.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a plurality of conduits extending from a kitchen area to bins in a level beneath the kitchen. In one embodiment, the upper ends of the conduits are concealed behind a vertical panel hinged at the lower edge to an "island" cabinet and forming a surface of the cabinet. The upper ends of the conduits are accessed by rotating the panel outwardly from the cabinet to expose the ends.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, in which.

DETAILED DESCRIPTION OF THE PREFERRED EMBODIMENTS

Figure 1:
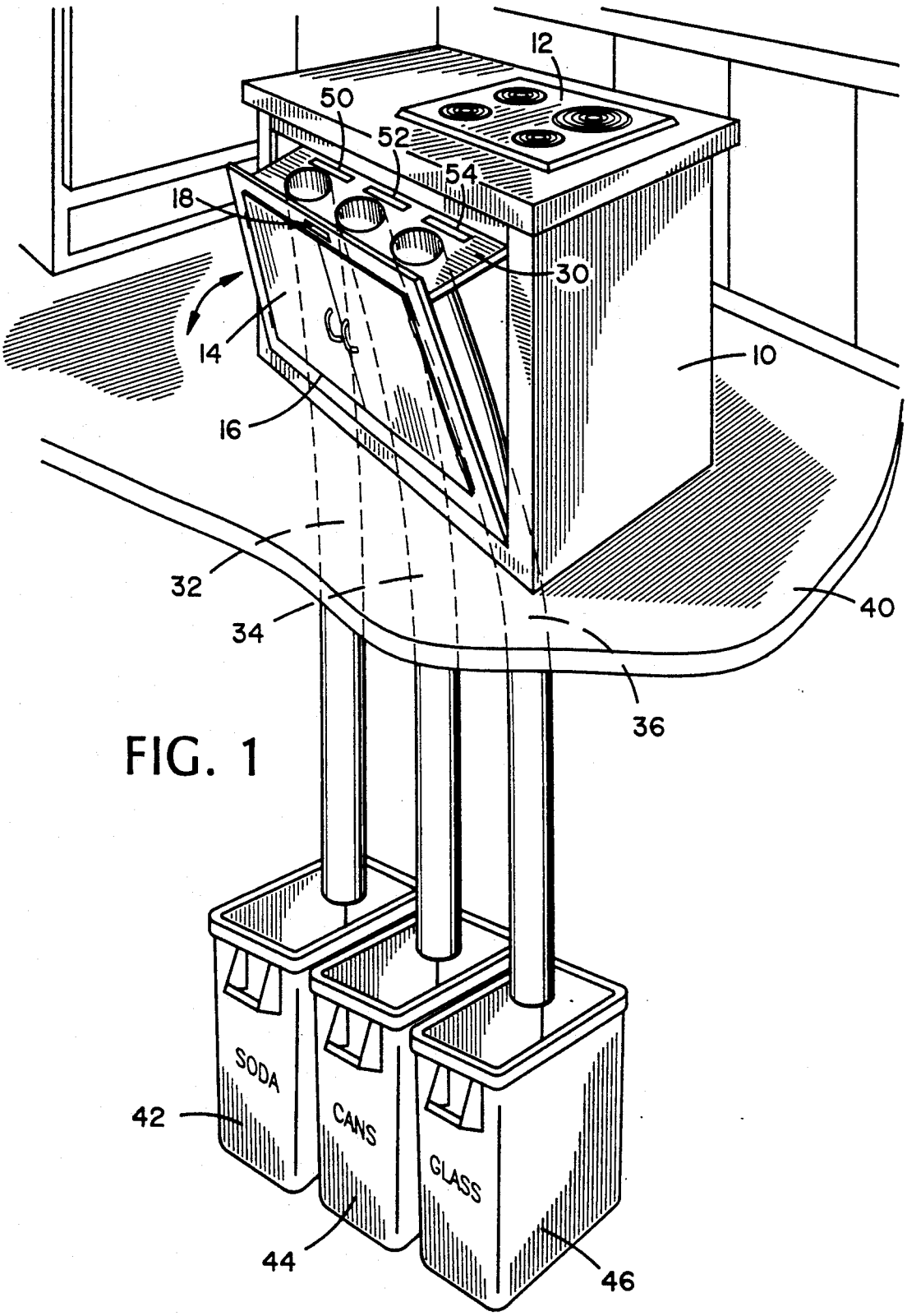
FIG. 1 is a perspective view of the present invention utilizing an "island" cabinet in a kitchen.

Referring now to the drawing figures, FIG. 1 illustrates the present invention installed in an "island" cabinet 10, which cabinet includes a range top 12 in the upper surface thereof. Disposed as a portion of one vertical surface of cabinet 10 is a panel 14 which is a simulated cabinet front. Panel 14 is hinged at the lower edge 16 thereof to cabinet 10 so that is may be rotated to the open position shown from a closed position (not shown), as indicated by the arrow. A recess 18 is provided to aid in manually rotating panel 14 to its open position.

A flat member 30 extends orthogonally from the inside surface of panel 14 and fits into otherwise dead space in cabinet 10 when the panel is closed. Three flexible, generally vertical conduits 32, 34, and 36, having their upper ends fixedly attached to member 30, extend through a floor 40 on which cabinet 10 is disposed and terminate at three bins 42, 44, and 46, respectively, disposed on a lower level. Bins 42, 44, and 46 are labelled SODA, CANS, and GLASS, respectively, and corresponding labels 50, 52, and 54 are disposed on member 30 adjacent the upper ends of conduits 32, 34, and 36.

In use, panel 14 is rotated to its open position shown on FIG. 1. One or more items to be segregated are inserted into the appropriate ends of conduits 32, 34, and 36 and fall into one or more of bins 42, 44, and 46. Conduits 32, 34, 36 have cross-sectional dimensions sufficient to permit the free fall by gravity therethrough of the items. Then, panel 14 is rotated to its closed position. Those of bins 42, 44, 46 containing nonrecyclable materials may be placed later at curbside or other locations for emptying by a trash hauler and the contents of those bins containing recyclable materials may be returned for refund of deposits.

Figure 2:
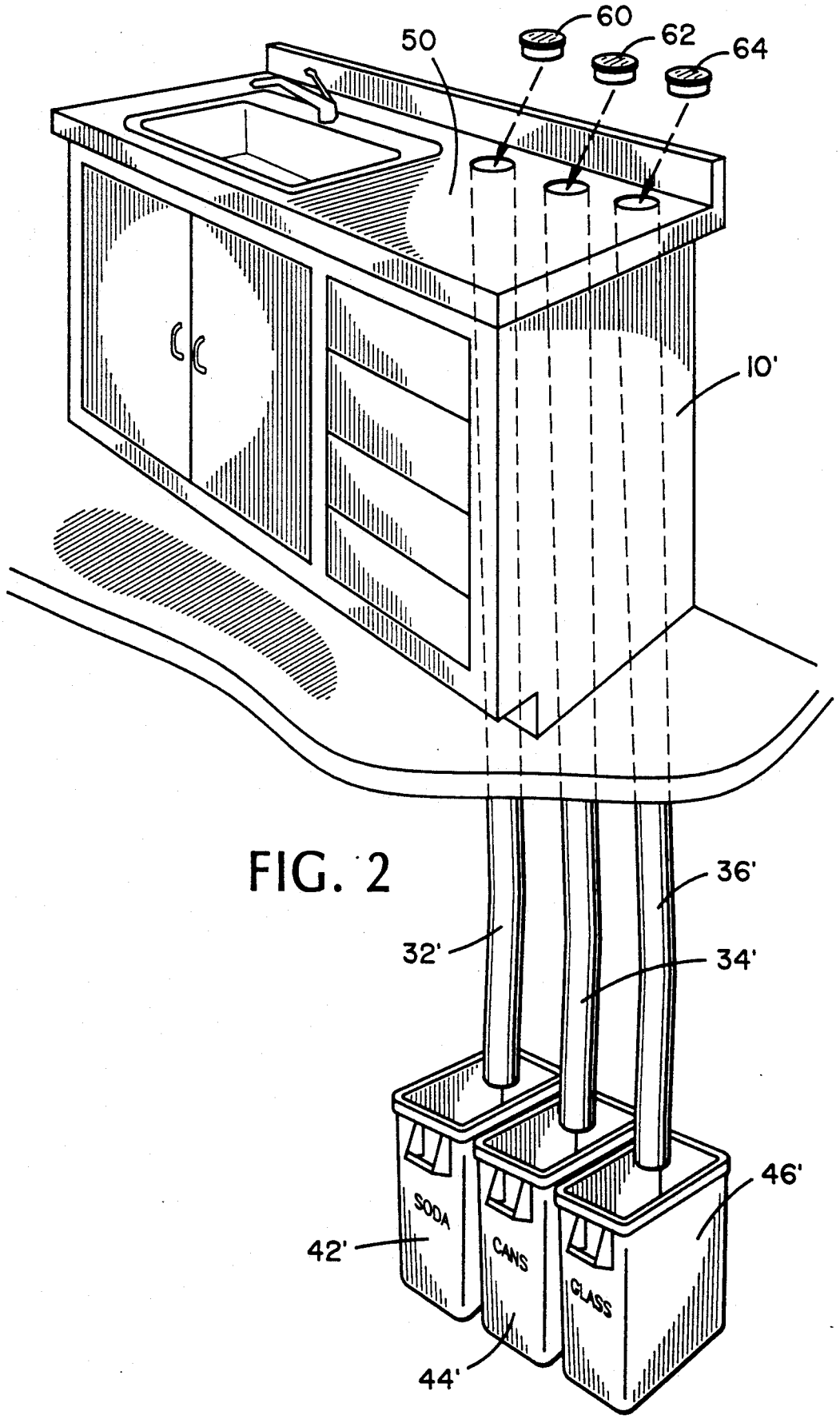
FIG. 2 is a perspective view of the present invention utilizing a base cabinet in a kitchen.

FIG. 2 illustrates the present invention incorporated in a kitchen base cabinet 10'. Here conduits 32', 34', and 36' extend from bins 42', 44' and 46' on a lower level. The uppers ends of conduits 32', 34', and 36' terminate at the rear of the working surface 50 of base cabinet 10' and the conduits pass near the rear of the base cabinet to avoid interference with shelving, drawers, etc. Covers 60, 62, and 64 are provided to keep items from unintentionally entering conduits 32', 34', and 36'.

Materials of construction of the present invention may be any known materials suitable for their intended use and may be easily incorporated into new cabinetry or may be incorporated into existing cabinetry with minor modifications thereof.

It is within the intent of the present invention that the arrangement shown on FIG. 1 may be incorporated into base cabinet 10' of FIG. 2 and that the arrangement of FIG. 2 may be incorporated into the the "island" cabinet 10 of FIG. 1.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An apparatus for segregating one or more materials selected from the group consisting of bottles and cans comprising:

(a) a normally vertical panel comprising a portion of a side of a cabinet disposed in an upper level of a structure, said panel being hingedly attached to said cabinet at the lower edge of said panel such that the upper edge of said panel can be rotated from and to said cabinet;

(b) a member fixedly attached to said panel and extending inwardly of said cabinet when said panel is vertical;

(c) a plurality of generally vertical conduits having upper ends thereof fixedly attached to and terminating at said member such that, when said upper edge of said panel is rotated from said cabinet, said upper ends of said conduits are exposed so that said materials may be inserted therein, and, when said upper edge of said panel is in its vertical position, said upper ends of said conduits are concealed within said cabinet;

(d) said conduits having cross-sectional dimensions sufficient to permit the fall by gravity therethrough of at least one of said materials; and (e) lower ends of said conduits terminating at receptacles in a lower level of said structure to receive said materials falling through said conduits.

2. An apparatus, as defined in claim 1, wherein said cabinet is an "island" cabinet.

3. An apparatus, as defined in claim 1, wherein said upper level is a kitchen area.

* * * * *